US005458407A

United States Patent [19]

Bustos et al.

[11] Patent Number: 5,458,407

[45] Date of Patent: Oct. 17, 1995

[54] MERCHANDISING DISPLAY

[75] Inventors: Rafael T. Bustos, Alpharetta; Leslie C. King, Snellville; Andrew L. Blackshaw, Dunwoody, all of Ga.

[73] Assignee: L&P Property Management Company, Chicago, Ill.

[21] Appl. No.: 122,054

[22] Filed: Sep. 15, 1993

Related U.S. Application Data

[63] Continuation-in-part of Ser. No. 48,585, Apr. 14, 1993, Pat. No. 5,277,486.

[51] Int. Cl.[6] ..... A47F 3/04

[52] U.S. Cl. ..... 312/116; 62/255; 312/125; 312/236

[58] Field of Search ..... 62/255, 298; 312/116, 312/125, 135, 305, 138.1, 236, 97.1, 36; D6/432, 436, 442, 443

[56] References Cited

U.S. PATENT DOCUMENTS

| | | | |
|---|---|---|---|
| D. 108,559 | 2/1938 | Boyce et al. . | |
| D. 130,995 | 1/1942 | Mayer . | |
| D. 188,498 | 8/1960 | Shears | D6/436 |
| 1,507,746 | 9/1924 | Malsin | 312/125 |
| 2,672,029 | 3/1954 | Saunders | 312/116 X |
| 3,115,019 | 12/1963 | Rutishauser . | |
| 3,129,039 | 4/1964 | Staley | 312/97.1 |
| 3,210,957 | 10/1965 | Rutishauser et al. | 62/255 |
| 3,216,775 | 11/1965 | Brenner | 312/236 |
| 3,366,432 | 1/1968 | Carmer | 62/255 X |
| 3,712,078 | 1/1973 | Maynard et al. . | |
| 3,769,805 | 11/1973 | Corini . | |
| 3,999,475 | 12/1976 | Roderick | 312/236 X |
| 4,089,322 | 5/1978 | Guibert | 312/236 X |
| 4,416,122 | 11/1983 | Johnson . | |
| 4,736,598 | 4/1988 | Sameshima et al. . | |
| 4,783,132 | 11/1988 | Baus | 312/138.1 X |
| 5,058,393 | 10/1991 | Callon et al. | 62/255 |
| 5,135,293 | 8/1992 | St-Germain et al. | 312/199 |
| 5,240,320 | 8/1993 | Yerman | 312/236 X |

FOREIGN PATENT DOCUMENTS

| | | | |
|---|---|---|---|
| 145841 | 6/1954 | Sweden | 312/116 |
| 843226 | 8/1960 | United Kingdom | 312/236 |

*Primary Examiner*—Kenneth J. Dorner
*Assistant Examiner*—Janet M. Wilkens
*Attorney, Agent, or Firm*—Wood, Herron & Evans

[57] ABSTRACT

A merchandising display including a housing enclosing a product display compartment having at least two adjacent columns of circularly shaped shelves rotatably mounted within the display compartment. When viewed in top plan view, the housing includes a front side having two doors which angle rearwardly to two outwardly curved side walls which are connected by a generally flat rear wall. The columns of circular shelves are disposed within the product compartment so as to be closely adjacent each other as well as the inner concavely shaped surfaces of the side walls. This creates a central air circulation path in the rear of the product compartment defined between the columns of circular shelves and the rear wall. A partition is secured to the rear wall at this central location and includes a plurality of apertures for directing cooled air from the air circulation path to the products on the shelves. A refrigeration unit is completely contained in a drawer at the base of the display for easy repair and maintenance.

24 Claims, 3 Drawing Sheets

MERCHANDISING DISPLAY

This is a continuation-in-part application of U.S. patent application Ser. No. 08/048,585 filed Apr. 14, 1993, now U.S. Pat. No. 5,277,486. The disclosure of U.S. Ser. No. 08/048,585 (the '585 application) is fully and expressly incorporated by reference herein.

FIELD OF THE INVENTION

This invention relates to a display for merchandising products and particularly to a refrigerated display for merchandising products such as refrigerated beverages. Specifically, the invention relates to a display having a design which promotes improved air flow and refrigeration efficiency as well as easier maintenance of refrigeration components and easier access to products contained with the display.

BACKGROUND OF THE INVENTION

Merchandising displays are commonly used in supermarkets as well as in other types of stores to display and merchandise items such as beverages which are generally handled as self-service items. In the past, merchandising displays have commonly been square or rectangular in shape when viewed in top plan view. Various ways to circulate refrigerated air in these units have included the use of air ducts disposed, for example, either centrally within the cabinet structure or at the rear wall of the cabinet structure. Examples incorporating this design are shown in U.S. Pat. No. 3,115,019 to Rutishauser and U.S. Pat. No. 3,366,432 to Carmer. The efficiency of cabinets having square or rectangular shapes as mentioned above is severely reduced by the practice of having large doors at the front of the cabinet to provide access to a relatively large quantity of product within the cabinet. Otherwise expressed, if there are ten columns of product displayed in a prior art refrigerated cabinet, then the access door of the cabinet has been 10 columns wide. This means that if the product is refrigerated, a large quantity of refrigerated air necessarily escapes from the cabinet every time the door is opened. Alternatively, if a small door is utilized, then only a relatively small number of columns of product may be stored within the cabinet so as to be accessible through that small door.

When an air duct is secured to the rear wall of a square or rectangular shaped cabinet, the air duct causes an inefficient use of space within the cabinet. In this regard, the air duct takes up space within the cabinet itself and also creates unusable gaps or wasted space between the shelves and the rear wall of the cabinet on either side of the air duct. Thus, with such a rear air duct in place, a square or rectangular shaped cabinet must be made larger or deeper than it otherwise would have to without the rear air duct. On the other hand, if a vertically extending air duct or air circulation path is not provided within the cabinet, then insufficient circulation of air within the cabinet may result.

Another problem associated with past front opening refrigerated displays involves the location of the refrigeration unit and its accessability for routine maintenance and other repair purposes. In this regard, although certain past displays have included means for removing the entire refrigeration for replacement purposes, prior refrigerated displays have generally incorporated refrigeration units which are difficult to access for maintenance and repair purposes.

SUMMARY OF THE INVENTION

It has therefore been one object of the present invention to efficiently utilize the space within the product display compartment of a merchandising display.

It has been another object of this invention to provide an improved rotatable shelf display which allows access to a large amount of product without allowing large amounts of refrigerated air to escape the product compartment when a door to the display is opened.

It has been yet another object of the invention to provide a merchandising display having a more efficiently designed air circulation path therein.

It has been a further object of the invention to provide a refrigerated merchandising display wherein the entire refrigeration unit is housed within the bottom of the merchandising display and slides in and out of the display for easy access during repair and maintenance thereof.

To these ends, the merchandising display of the present invention includes two columns of rotatable shelves which are mounted within a housing comprising a front side which includes two doors, one for accessing each column of shelves, two outwardly curved side walls, and a generally flat rear wall. The two doors are mounted in the front side such that each door angles rearwardly from a central portion of the front side. A refrigeration unit is housed within a compartment located within the base of the merchandising display below the product display compartment. The refrigeration unit comprises conventional components including a compressor, a condenser, and an evaporator unit. The compressor, condenser, and evaporator units are mounted in a drawer which slides in and out of the bottom of the merchandising display.

The product display compartment of the merchandising display further includes a vertically extending partition which separates rear edges of the two columns of shelves from the rear wall of the product compartment. The lower end of the partition communicates with a hole in the floor of the product compartment through which cold air is forced by the fan of the evaporator unit. The partition includes apertures which are situated between the various shelves of each column so that some of the air being directed up the partition flows out of each of the apertures and between adjacent shelves within the product compartment. The remaining air exits the air channel created by the partition at the top of the product display compartment to be recirculated downwardly through holes or slots in the floor of the product compartment and back through the coils of the evaporator unit.

The partition includes a forward "V"-shaped portion situated closely adjacent to or abutting the respective columns of circular shelves. The "V"-shaped portion includes an apex which extends between the two columns of shelves and the partition further includes outwardly flared rearward portions which extend from the "V"-shaped portion and are disposed closely adjacent the rearward edges of the shelves in each respective column. Thus, the flared rearward portions of the partition efficiently direct air to the rear of the product display compartment while the forward "V"-shaped portion efficiently directs air more centrally within the product display compartment. The merchandising display also preferably includes a vertical support disposed between the two columns of shelves and in front of the partition to serve in conjunction with the partition and side walls of the display as a mounting for the shelves. The circular shelves are preferably mounted for rotation to these support surfaces and may, for example, also be mounted using the gravity feed system of the '585 application.

One advantage of the present invention is provided by the partition which directs air within both the rear of the product display compartment and a central portion of the product display compartment to more efficiently circulate the cooled air within the compartment. Further advantages are realized by the use of multiple columns of circular and preferably rotatable shelves which allow easy access to a large amount of product without causing large losses of refrigerated air during such access. Moreover, the refrigeration unit is housed within a drawer at the bottom of the display and is therefore easily accessible for repair and maintenance purposes.

These and other objects and advantages of the invention will become more readily apparent to those of ordinary skill in the art from the following detailed description taken in conjunction with the accompanying drawings.

DETAILED DESCRIPTION OF THE PREFERRED EMBODIMENT

Figure 1:
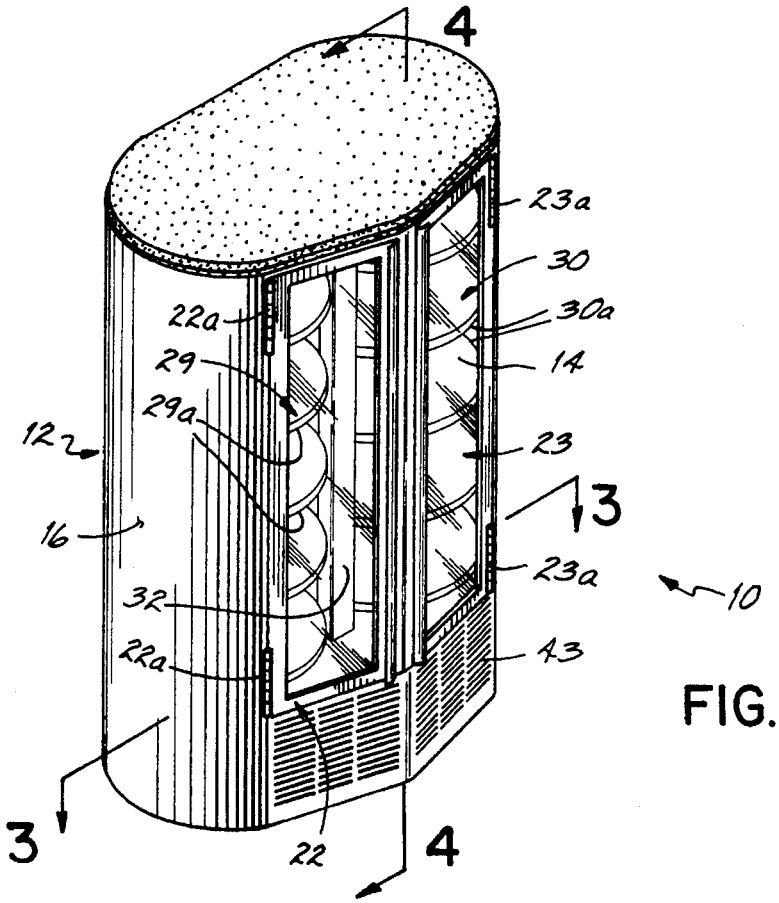
FIG. 1 is a perspective view of the merchandising display of the present invention.
Figure 3:
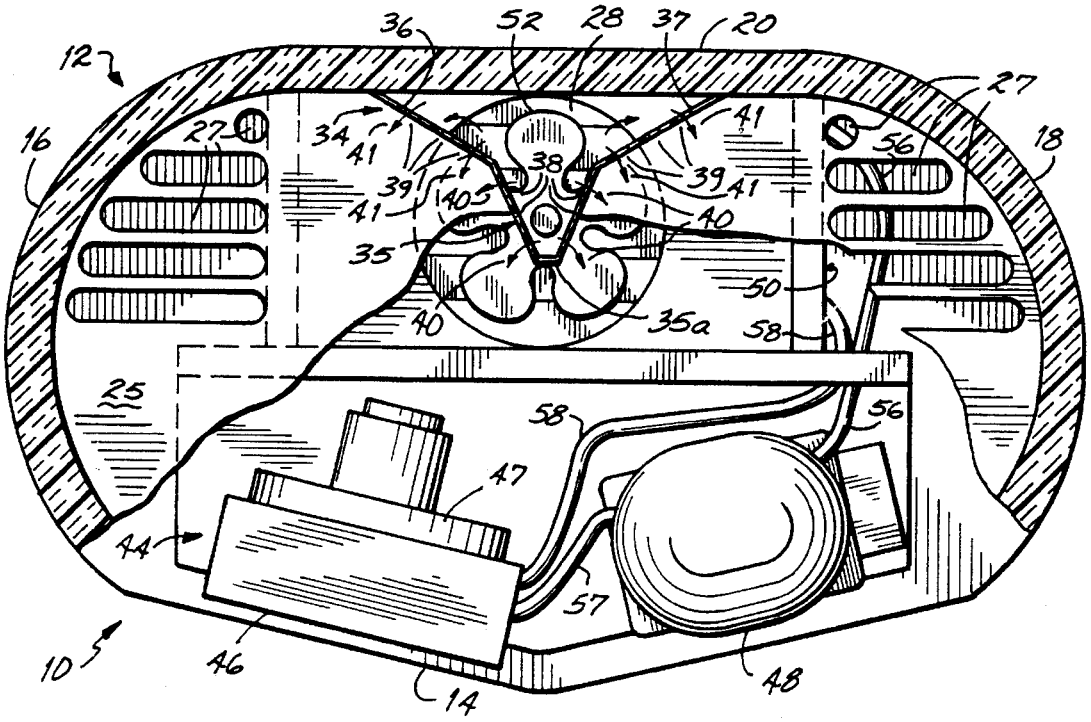
FIG. 3 is a cross-sectional view taken on line 3—3 of FIG. 1.

As shown best in FIG. 1 taken in conjunction with FIG. 3, the preferred embodiment of the present invention comprises a merchandising display 10 formed by a housing 12 having a front side 14, a pair of insulated side walls 16, 18 which curve outwardly from the front side 14 and are connected by a generally flat insulated rear wall 20. The front side 14 is comprised of a pair of doors 22, 23 which each angle rearwardly from a central portion of the front side 14. The doors 22, 23 are also preferably designed to open centrally of the front side 14 and include respective spring hinges 22*a*, 23*a* which maintain the doors 22, in a normally closed position. As is conventional in the art, the doors may be latched shut with conventional magnetic or mechanical latches which form no part of the present invention and therefore are not shown.

Figure 2:
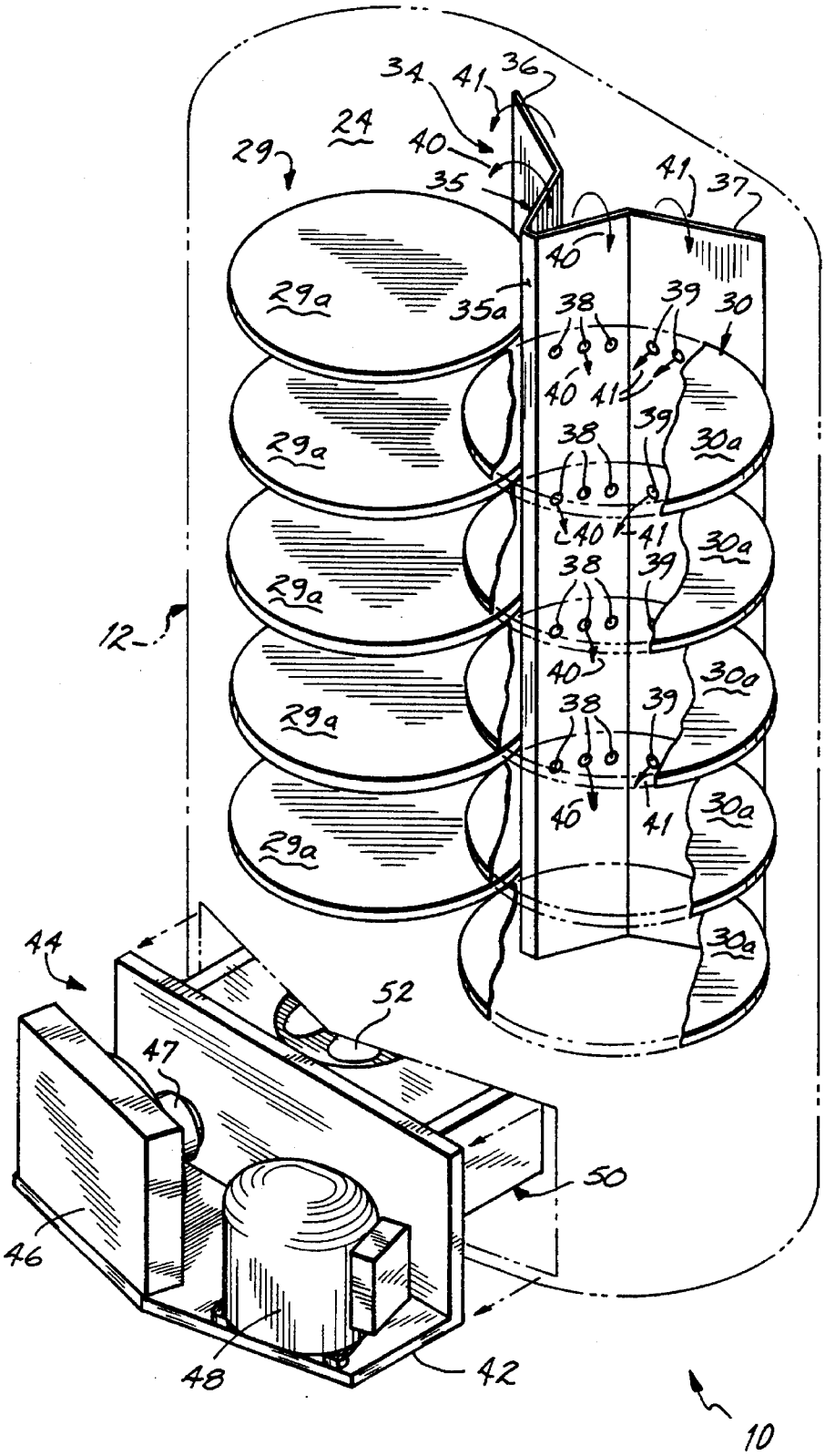
FIG. 2 is a diagrammatic perspective view of the merchandising display showing the two columns of shelves, the air circulation channel, and the refrigeration unit drawer.
Figure 4:
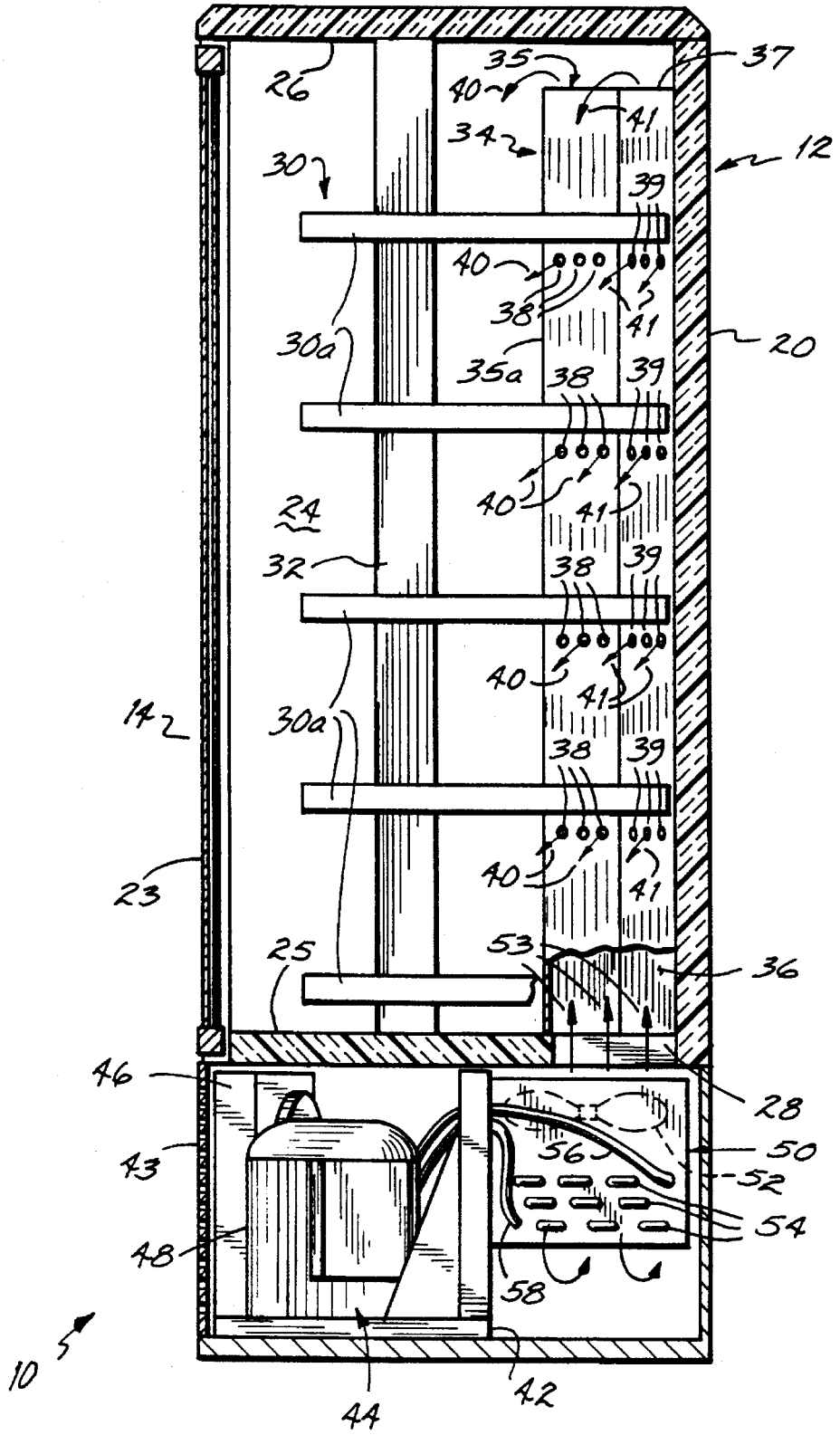
FIG. 4 is a cross-sectional view taken on line 4—4 of FIG. 1.

Referring now to FIG. 2, the merchandising display 10 further includes a product display compartment 24 including two columns 29, 30 of circular shelves 29*a*, 30*a*. The circular shelves 29*a*, 30*a* are preferably rotatably mounted within the product compartment 24. The specific type of rotatable mounting does not form part of the present invention but may, for example, generally be designed according to the mounting system disclosed in the above-incorporated '585 application. A vertical support 32, shown in FIGS. 1 & 4, is provided to assist in supporting the shelves 29*a*, 30*a* within the product display compartment 24. The column 29 of shelves 29*a* is accessible through door 22 while the column 30 of shelves 30*a* is accessible through door 23 on the front side 14 of the housing 12.

A partition 34 is rigidly secured to the inside surface of the rear wall 20 in suitable manner such as by welding, rivets, or bolts (not shown). The partition 34 creates a vertical air path for directing refrigerated air throughout the product display compartment 24 from a refrigeration unit 44 to be described below. The partition 34 includes a front "V"-shaped portion 35 and rear flared portions 36, 37 extending rearwardly from respective legs of the V-shaped portion 35. The V-shaped portion 35 further includes an apex 35*a* which extends into a central region of the product compartment 24 between the two columns 29, 30 of circular shelves 29*a*, 30*a*.

As shown in FIGS. 3 and 4, the product display compartment 24 is separated from the base of the display 10 by a bottom wall or floor 25. A removable grill 43, shown best in FIG. 1, is provided at the base of the front side 14 of the housing 12 for covering a drawer 42 containing the refrigeration unit 44. The drawer 42 containing the refrigeration unit 44 slides in and out of the base of the housing 12 to allow easy maintenance and repair of the refrigeration unit 44. (FIG. 2). For clarity, the specific hardware necessary for allowing such sliding movement of the drawer 42 has not been shown, however, such hardware preferably takes the form of conventional drawer sliding mechanisms, such as rollers and tracks, appropriately affixed and located on opposite sides of the drawer 42. As shown in FIG. 3, the floor 25 include slots 27 and central hole 28 for allowing air to properly circulate from the product display compartment 24 through the refrigeration unit 44. As further shown in FIG. 3, the refrigeration unit 44 comprises conventional heat exchange components which include a condenser unit 46 having a fan 47, a compressor 48, and an evaporator unit 50 having a fan 52 for distributing cooled air upwardly into the product display compartment 24. In a conventional manner, refrigerant is directed between the various components of the refrigeration unit 44 via fluid lines 56, 57, 58. As the refrigeration unit 44 itself is conventional and forms no part of the invention, further detailed description of the components thereof is not necessary.

The evaporator unit 50 is located at the rear of the drawer 42 such that its fan 52 is situated directly beneath the lower end of the partition 34 within the product display compartment 24. As mentioned above, the floor 25 of the product display compartment 24 includes a hole 28 which is shaped identically to the cross-sectional shape of the partition 34 such that air being pulled through the evaporator unit by the fan 52 is directed upwardly through the space or air path created between the partition 34 and the inside surface of the rear wall 20. Of course, other types of fans may be used in place of the bladed fan 52 shown in FIGS. 2 and 3 and may, for example, include fans having a "squirrel cage" design.

Operation

The refrigeration unit 44, as most completely shown in FIG. 2, operates according to a conventional refrigeration cycle as mentioned above. Air is cooled by the refrigeration cycle of the condenser unit 46, compressor 48 and evaporator 50. The cooled air is drawn through the evaporator 50 and over the cooling coils 54 by the fan 52 which then directs the cooled air into the product display compartment 24 via the rear air circulation path defined by the partition 34.

Referring now to FIG. 4, the fan 52 associated with the evaporator 50 forces cooled air through the hole 28 in the floor 25 of the product compartment 24 as indicated by the arrows 53. The cooled air travels upwardly into the air path defined between the partition 34 and the rear wall 20 of the display 10. As shown in both FIGS. 3 and 4, some of this cooled air is directed out of apertures 38 in the V-shaped portion 35 of the partition 34 and some of the air is directed out of apertures 39 in the flared portions 36, 37 of the partition 34. The air being directed out of the apertures 38 in the "V"-shaped portion 35, as indicated by arrows 40, is directed centrally into the product display compartment while the air being directed out of the apertures 39, as indicated by arrows 41, is directed more towards the rear of the product display compartment 24. The cooled air which does not pass through the partition 34 via either apertures 38 or 39 exits the partition 34 at the top thereof proximate the top wall or ceiling 26 of the housing 12. All of the air that enters the product display compartment 24 via the partition 34 is eventually circulated back down to the bottom of the product display compartment where it passes through the slots 27 in the floor 25 and is again drawn through the evaporator 50 by the fan 52.

Referring back to FIG. 1, when a customer desires to retrieve a product, such as a beverage, from the product compartment 24 of the display 10 one of the doors 22 or 23 is opened to retrieve the beverage from the corresponding column 29 or 30 of shelves 29*a*, 30*a*. Because the doors may be made relatively small while still providing access to all the product on the corresponding rotatable shelves, refrigerated air loss from the product compartment 24 is minimized. Also, refrigerated air is distributed very efficiently within the product compartment 24 due to the combination of adjacent columns of circularly shaped shelves and the curved side walls connected by the rear wall which results in the creation of an air circulation path at the rear of the product display compartment 24.

When repair or maintenance is necessary on the refrigeration unit 44, the grill 43 is removed and the drawer 42 containing the refrigeration unit 44 is pulled at least partially out of the base or bottom of the housing 12 to expose the various components of the refrigeration unit 44. Thus, repair and maintenance of the condenser 46, compressor 48, evaporator 50 and all of the other various associated components may be made by ready access at ground level.

While a preferred embodiment of the present invention has been described in detail above, the artisan of ordinary skill will readily recognize many modifications thereof and applicant therefore intends to be bound only by the scope of the claims appended hereto.

We claim:

1. A merchandising display comprising:

a housing having an enclosed display compartment, said housing when viewed in top plan view having a front side, and first and second outwardly curved side walls connecting said front side to a generally flat, unitary rear wall, said first and second outwardly curved side walls each including a front curved portion connected to said front side and a rear curved portion connected to said rear wall, at least one door mounted in said front side for accessing said display compartment, first and second columns of vertically spaced circular shelves mounted within said compartment, said first column being disposed adjacent said first curved side wall and said second column being disposed adjacent said second curved side wall, an enclosed central air circulation path bounded by an apertured partition extending vertically between said first and second columns of circular shelves and said rear wall, and a refrigeration unit disposed within said housing and including a fan for directing cooled air into said air circulation path.

2. The merchandising display of claim 1 wherein said housing includes a top and a bottom and said refrigeration unit is disposed within a slidably mounted drawer located at the bottom of said housing, said refrigeration unit comprising an evaporator unit, condenser unit and compressor.

3. The merchandising display of claim 1 wherein said shelves are rotatably mounted to said housing.

4. The merchandising display of claim 1 wherein said partition extends between said first and second columns of shelves and said rear wall, said partition including a first series of apertures for directing air forwardly from said central air circulation path into a central portion of said compartment between said first and second columns of shelves and a second series of apertures located rearward of said first series for directing air from said central air circulation path into a rear portion of said compartment.

5. The merchandising display of claim 4 wherein said partition comprises a "V"-shaped portion having an apex extending between said first and second columns of circular shelves and having said first series of apertures therein.

6. The merchandising display of claim 5 wherein said partition further comprises a pair of flared portions extending at an angle from said "V"-shaped portion toward said rear wall and including said second series of apertures therein.

7. The merchandising display of claim 1 further comprising two doors mounted in said front side for accessing said first and second columns of shelves.

8. The merchandising display of claim 7 wherein said doors angle rearwardly from a central portion of said front side to the respective side walls of said housing.

9. A merchandising display comprising:

a housing having an enclosed display compartment, said housing when viewed in top plan view having a front side, and first and second outwardly curved side walls connecting said front side to a generally flat, unitary rear wall, said first end second outwardly curved side walls each including a front curved portion connected to said front side and a rear curved portion connected to said rear wall, at least one door mounted in said front side for accessing said display compartment, first and second columns of vertically spaced circular shelves mounted within said compartment, said first column being disposed adjacent said first curved side wall and said second column being disposed adjacent said second curved side wall, said shelves being mounted for rotation within said compartment, an enclosed central air circulation path bounded by an apertured partition extending vertically between said first and second columns of circular shelves and said rear wall, and a refrigeration unit disposed within said housing and including a fan for directing cooled air into said air circulation path.

10. The merchandising display of claim 9 wherein said housing includes a top and a bottom and said refrigeration unit is disposed within a slidably mounted drawer located at the bottom of said housing, said refrigeration unit comprising an evaporator unit, condenser unit and compressor.

11. The merchandising display of claim 9 wherein said partition extends between said first and second columns of shelves and said rear wall, said partition including a first series of apertures for directing air forwardly from said central air circulation path into a central portion of said compartment between said first and second columns of shelves and a second series of apertures located rearward of said first series for directing air from said central air circulation path into a rear portion of said compartment.

12. The merchandising display of claim 11 wherein said partition comprises a "V"-shaped portion having an apex extending between said first and second columns of circular shelves and having said first series of apertures therein.

13. The merchandising display of claim 12 wherein said partition further comprises a pair of flared portions extending at an angle from said "V"-shaped portion toward said rear wall and including said second series of apertures therein.

14. The merchandising display of claim 9 further comprising two doors mounted in said front side for accessing said first and second columns of shelves.

15. The merchandising display of claim 14 wherein said doors angle rearwardly from a central portion of said front side to the respective side walls of said housing.

16. A merchandising display comprising:

a housing having an enclosed display compartment, said housing when viewed in top plan view having a front side, and first and second outwardly curved side walls connecting said front side to a generally flat rear wall, at least one door mounted in said front side for accessing said display compartment, first and second columns of vertically spaced circular shelves mounted within said compartment, said first column being disposed adjacent said first curved side wall and said second column being disposed adjacent said second curved side wall, said shelves being mounted for rotation within said compartment, and a central air circulation path extending vertically between said first and second columns of circular shelves and said rear wall, said central air circulation path being bounded by a vertical partition extending between said first and second columns of shelves and said rear wall, said partition including a first series of apertures for directing air forwardly from said central air circulation path into a central portion of said compartment between said first and second columns of shelves and a second series of apertures located rearward of said first series for directing air from said central air circulation path into a rear portion of said compartment, and a refrigeration unit disposed within said housing and including a fan for directing cooled air into said air circulation path.

17. The merchandising display of claim 16 wherein said partition comprises a "V"-shaped portion having an apex extending between said first and second columns of circular shelves and having said first series of apertures therein.

18. The merchandising display of claim 17 wherein said partition further comprises a pair of flared portions extending at an angle from said "V"-shaped portion toward said rear wall and including said second series of apertures therein.

19. The merchandising display of claim 18 wherein said housing includes a top and a bottom and said refrigeration unit is disposed within a slidably mounted drawer located at the bottom of said housing, said refrigeration unit comprising an evaporator unit, condenser unit and compressor.

20. The merchandising display of claim 16 further comprising two doors mounted in said front side for accessing said first and second columns of shelves.

21. The merchandising display of claim 20 wherein said doors angle rearwardly from a central portion of said front side to the respective side walls of said housing.

22. A merchandising display comprising:

a housing having an enclosed display compartment, said housing when viewed in top plan view having a front side, and first and second outwardly curved side walls connecting said front side to a generally flat rear wall, at least one door mounted in said front side for accessing said display compartment, first and second columns of vertically spaced circular shelves mounted within said compartment, said first column being disposed adjacent said first curved side wall and said second column being disposed adjacent said second curved side wall, a central air circulation path extending vertically between said first and second columns of circular shelves and said rear wall, said central air circulation path being bounded by a vertical partition extending between said first and second columns of shelves and said rear wall, said partition including a first series of apertures for directing air forwardly from said central air circulation path into a central portion of said compartment between said first and second columns of shelves and a second series of apertures located rearward of said first series for directing air from said central air circulation path into a rear portion of said compartment, and a refrigeration unit disposed within said housing and including a fan for directing cooled air into said air circulation path.

23. The merchandising display of claim 22 wherein said partition comprises a "V"-shaped portion having an apex extending between said first and second columns of circular shelves and having said first series of apertures therein.

24. The merchandising display of claim 23 wherein said partition further comprises a pair of flared portions extending at an angle from said "V"-shaped portion toward said rear wall and including said second series of apertures therein.

* * * * *

UNITED STATES PATENT AND TRADEMARK OFFICE

CERTIFICATE OF CORRECTION

PATENT NO. : 5,458,407
DATED : October 17, 1995
INVENTOR(S) : Rafael T. Bustos et al.

It is certified that error appears in the above-indentified patent and that said Letters Patent is hereby corrected as shown below:

Col. 3, line 44, "22" should be -- 22, 23 --.

Col. 6, line 37, "end" should be -- and --.

Signed and Sealed this

Twenty-sixth Day of March, 1996

*Attest:*

Bruce Lehman

BRUCE LEHMAN

*Attesting Officer*

*Commissioner of Patents and Trademarks*